US011527226B2

(12) United States Patent
Sasaki et al.

(10) Patent No.: US 11,527,226 B2
(45) Date of Patent: Dec. 13, 2022

(54) AUDIO PARAMETER ADJUSTMENT APPARATUS, AUDIO PARAMETER ADJUSTMENT METHOD AND NON-TRANSITORY COMPUTER READABLE MEDIUM STORING AUDIO PARAMETER ADJUSTMENT PROGRAM

(71) Applicant: Yamaha Corporation, Hamamatsu (JP)

(72) Inventors: Naoya Sasaki, Hamamatsu (JP); Koichi Kashiwazaki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 211 days.

(21) Appl. No.: 16/991,135

(22) Filed: Aug. 12, 2020

(65) Prior Publication Data

US 2020/0372883 A1 Nov. 26, 2020

Related U.S. Application Data

(63) Continuation of application No. PCT/JP2018/005094, filed on Feb. 14, 2018.

(51) Int. Cl.

| | |
|---|---|
| ***G10H 1/057*** | (2006.01) |
| ***G10H 1/00*** | (2006.01) |
| ***G10H 1/46*** | (2006.01) |

(52) U.S. Cl.

CPC ..... *G10H 1/057* (2013.01); *G10H 1/0008* (2013.01); *G10H 1/46* (2013.01)

(58) Field of Classification Search

CPC ..... G10H 1/057; G10H 1/0008; G10H 1/46
USPC ..... 381/119
See application file for complete search history.

(56) References Cited

U.S. PATENT DOCUMENTS

| | | | | |
|---|---|---|---|---|
| 7,812,242 | B2 * | 10/2010 | Yamabata | G10H 1/053 84/629 |
| 8,110,735 | B2 * | 2/2012 | Watanabe | G10H 1/0091 84/626 |
| 2003/0167907 | A1 * | 9/2003 | Annen | G10H 1/46 84/615 |

(Continued)

FOREIGN PATENT DOCUMENTS

| | | | | |
|---|---|---|---|---|
| CN | 104583926 | A * | 4/2015 | G06F 3/04842 |
| JP | 2003-195868 | A | 7/2003 | |

(Continued)

OTHER PUBLICATIONS

International Search Report (PCT/ISA/210) issued in PCT Application No. PCT/JP2018/005094 dated May 15, 2018 with English translation (four (4) pages).

(Continued)

*Primary Examiner* — Christina M Schreiber
(74) *Attorney, Agent, or Firm* — Crowell & Moring LLP

(57) ABSTRACT

A reference part determiner determines a reference part from a plurality of parts including at least three parts. A subject part group determiner determines a subject part group from the plurality of parts, excluding the reference part determined by the reference part determiner out of the plurality of parts as a subject part group. An acquirer acquires a change pattern of a first audio parameter value set for the reference part. A changer changes a second audio parameter value set for the subject part group determined by the subject part group determiner according to a change pattern acquired by the acquirer.

18 Claims, 9 Drawing Sheets

(56) References Cited

U.S. PATENT DOCUMENTS

| | | | | |
|---|---|---|---|---|
| 2004/0177745 | A1* | 9/2004 | Kayama | G10H 1/0008 84/609 |
| 2011/0196522 | A1* | 8/2011 | Zakirov | H04S 7/305 700/94 |
| 2012/0243711 | A1* | 9/2012 | Fujita | H04R 3/005 381/119 |
| 2017/0221464 | A1* | 8/2017 | Ohta | G06F 3/011 |
| 2019/0073988 | A1* | 3/2019 | Ohta | G10H 1/053 |
| 2020/0243056 | A1* | 7/2020 | Oba | G10H 1/053 |
| 2020/0372883 | A1* | 11/2020 | Sasaki | G10H 1/057 |
| 2021/0295810 | A1* | 9/2021 | Sasaki | G10H 1/344 |

FOREIGN PATENT DOCUMENTS

| | | | | | |
|---|---|---|---|---|---|
| JP | 2003195868 | A | * | 7/2003 | |
| JP | 2004-258564 | A | | 9/2004 | |
| JP | 2004258564 | A | * | 9/2004 | |
| JP | 2016-81045 | A | | 5/2016 | |
| JP | 2016081045 | A | * | 5/2016 | G06F 3/011 |

OTHER PUBLICATIONS

Japanese-language Written Opinion (PCT/ISA/237) issued in PCT Application No. PCT/JP2018/005094 dated May 15, 2018 (four (4) pages).

Japanese-language Office Action issued in Japanese Application No. 2019-571861 dated Aug. 31, 2021 with English translation (12 pages).

* cited by examiner

FIG. 6

CONDITION TABLE

| SELECTION SUBJECT PARAMETER | PCM | | | | FM | |
|---|---|---|---|---|---|---|
| | NORMAL PART | | RHYTHM PART | | | |
| | NAME OF PARAMETER | CHANGE COEFFICIENT | NAME OF PARAMETER | CHANGE COEFFICIENT | NAME OF PARAMETER | CHANGE COEFFICIENT |
| VOLUME | VOLUME | 36 | VOLUME | 36 | VOLUME | 36 |
| CUTOFF | ELEM CUTOFF | 54 | × | × | CUTOFF | 65 |
| RESONANCE | ELEM RESONANCE | 55 | × | × | RESONANCE | 66 |
| PITCH | PITCH | 35 | × | × | PITCH | 35 |
| PAN | ELEM PAN | 42 | × | × | PAN | 57 |
| REV SEND | REV SEND | 31 | REV SEND | 31 | REV SEND | 31 |
| ⋮ | ⋮ | ⋮ | ⋮ | ⋮ | ⋮ | ⋮ |

FIG. 7

| SET NUMBER | PARAMETER CONTROL INFORMATION | | |
|---|---|---|---|
| | REFERENCE PARAMETER | CONTROL PARAMETER | CHANGE COEFFICIENT |
| 1 | KNOB 1 | VOLUME | 32 |
| 2 | FOOT CONTROLLER 1 | CUT OFF | 61 |
| 3 | | | |
| 4 | | | |
| ⋮ | ⋮ | ⋮ | ⋮ |
| 16 | | | |

AUDIO PARAMETER ADJUSTMENT APPARATUS, AUDIO PARAMETER ADJUSTMENT METHOD AND NON-TRANSITORY COMPUTER READABLE MEDIUM STORING AUDIO PARAMETER ADJUSTMENT PROGRAM

BACKGROUND OF THE INVENTION

The present subject matter relates to an audio parameter adjustment apparatus, an audio parameter adjustment method and a non-transitory computer readable storing an audio parameter adjustment program for adjusting an audio parameter that is set for a part.

DESCRIPTION OF RELATED ART

In an electronic musical apparatus that can play a plurality of parts, there is a technique for changing an audio parameter value of one part according to a change of an audio parameter value of another part. In a contents control device described in JP 2016-81045 A, a parameter value is calculated based on an envelope of an input audio waveform, and the parameter value is supplied to a tone generation circuit. Thus, according to an envelope of an audio waveform of a predetermined performance part out of a plurality of performance parts, the generation manner of a musical sound of another performance part can be automatically changed, for example.

BRIEF SUMMARY OF THE INVENTION

However, in the contents control device of the above-mentioned JP 2016-81045 A, specialized knowledge and a complicated setting operation are required in order to appropriately set the relationship among the plurality of performance parts. It is not easy for an unskilled user to make such settings.

An object of the present subject matter is to provide an audio parameter adjustment apparatus, an audio parameter adjustment method and a non-transitory computer readable storing an audio parameter adjustment program for enabling the change of audio parameter values of a plurality of parts easily and effectively.

An audio parameter adjustment apparatus according to the present subject matter includes a reference part determiner that determines one part out of a plurality (three or more) of parts as a reference part, a subject part group determiner that determines a plurality of other parts except for the reference part out of the plurality of parts as a subject part group, an acquirer that acquires a change pattern of a value of a first audio parameter set for the reference part, and a changer that changes a value of a second audio parameter set for the subject part group according to the acquired change pattern.

The first audio parameter may be a volume, and the change pattern may be an envelope representing a temporal change in volume.

The audio parameter adjustment apparatus may further includes a receiver that receives selection of the second audio parameter, and a judge that judges whether a value of the selected second audio parameter is to be changed in regard to each part of the subject part group based on the selected second audio parameter and a changeability condition, wherein the changer may change the value of the second audio parameter according to the change pattern in regard to a part having the value of the second audio parameter that has been judged to be changed in the subject part group. The audio parameter adjustment apparatus may further include a setter that sets a change coefficient indicating a degree to which the second audio parameter is to be changed for a part having the value of the second audio parameter that has been judged to be changed based on the selected second audio parameter and a coefficient setting condition.

The reference part determiner may determine a part satisfying a determination condition out of the plurality of parts as the reference part. The determination condition may be that the value of the first audio parameter shifts between an upper range and a lower range a certain number of times or more in a certain period of time with a threshold value used as a boundary between the upper range and the lower range. The determination condition may be that an arpeggio is set.

An audio parameter adjustment method according to the present subject matter includes determining one part out of a plurality (three or more) of parts as a reference part, determining a plurality of other parts except for the reference part out of the plurality of parts as a subject part group, acquiring a change pattern of a value of a first audio parameter set for the reference part, and changing a value of a second audio parameter set for the subject part group according to the acquired change pattern.

The first audio parameter may be a volume, and the change pattern may be an envelope representing a temporal change in volume.

The audio parameter adjustment method may further include receiving selection of the second audio parameter, and judging whether a value of the selected second audio parameter is to be changed in regard to each part of the subject part group based on the selected second audio parameter and a changeability condition, wherein the changing a value of the second audio parameter may include changing the value of the second audio parameter according to the change pattern in regard to a part having the value of the second audio parameter that has been judged to be changed in the subject part group. The audio parameter adjustment method may further include setting a change coefficient indicating a degree to which the second audio parameter is to be changed for a part having the value of the second audio parameter that has been judged to be changed based on the selected second audio parameter and a coefficient setting condition.

The determining a reference part may include determining a part satisfying a determination condition out of the plurality of parts as the reference part. The determination condition may be that the value of the first audio parameter shifts between an upper range and a lower range a certain number of times or more in a certain period of time with a threshold value used as a boundary between the upper range and the lower range. The determination condition may be that an arpeggio is set.

A non-transitory computer readable medium storing an audio parameter adjustment program according to the present subject matter, the audio parameter adjustment program, when executed by a computer, causing the computer to determine one part out of a plurality (three or more) of parts as a reference part, determine a plurality of other parts except for the reference part out of the plurality of parts as a subject part group, acquire a change pattern of a value of a first audio parameter set for the reference part, and change a value of a second audio parameter set for the subject part group according to the acquired change pattern.

The first audio parameter may be a volume, and the change pattern may be an envelope representing a temporal change in volume.

The non-transitory computer readable medium storing the audio parameter adjustment program, when executed by a computer, the audio parameter adjustment program may further cause the computer to receive selection of the second audio parameter, judge whether a value of the selected second audio parameter is to be changed in regard to each part of the subject part group based on the selected second audio parameter and a changeability condition, wherein the changing a value of the second audio parameter may include changing the value of the second audio parameter according to the change pattern in regard to a part having the value of the second audio parameter that has been judged to be changed in the subject part group. The non-transitory computer readable medium storing the audio parameter adjustment program may further include setting a change coefficient indicating a degree to which the second audio parameter is to be changed for a part having the value of the second audio parameter that has been judged to be changed based on the selected second audio parameter and a coefficient setting condition.

The determining a reference part may include determining a part satisfying a determination condition out of the plurality of parts as the reference part. The determination condition may be that the value of the first audio parameter shifts between an upper range and a lower range a certain number of times or more in a certain period of time with a threshold value used as a boundary between the upper range and the lower range. The determination condition may be that an arpeggio is set.

Other features, elements, characteristics, and advantages of the present subject matter will become more apparent from the following description of preferred embodiments of the present subject matter with reference to the attached drawings.

BRIEF DESCRIPTION OF THE SEVERAL VIEWS OF THE DRAWING

FIG. 6 is a diagram showing one example of a condition table;

FIG. 7 is a diagram showing an example of a plurality of parameter control information pieces stored in a plurality of setting storage regions;

DESCRIPTION OF THE PREFERRED EMBODIMENTS

An audio parameter adjustment apparatus, an audio parameter adjustment method and a non-transitory computer readable medium storing an audio parameter adjustment program according to embodiments of the present subject matter will be described below in detail with reference to the drawings.

[1] Configuration of Electronic Musical Apparatus

Figure 1:
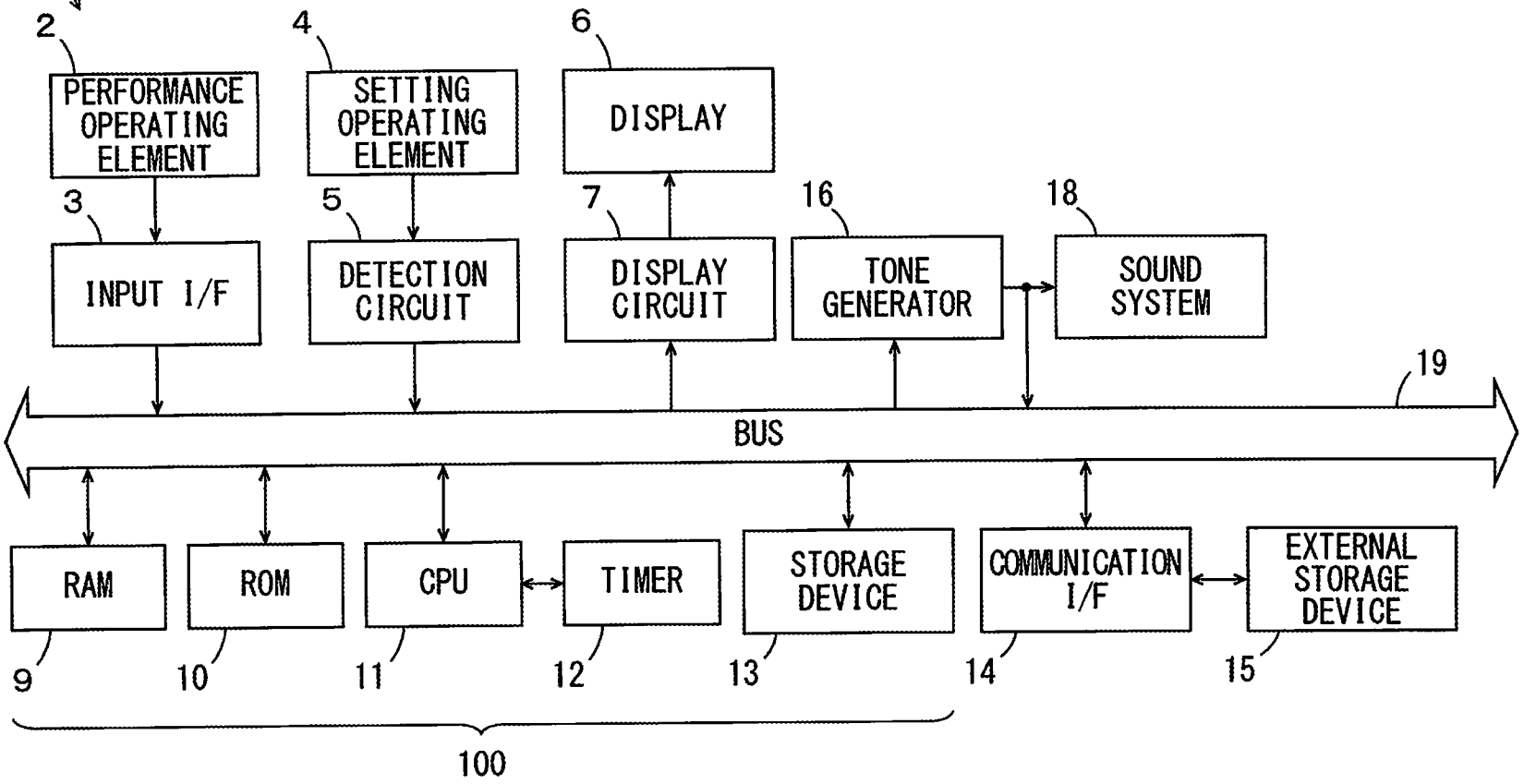
FIG. 1 is a block diagram showing the configuration of an electronic musical apparatus according to an embodiment of the present subject matter.

FIG. 1 is a block diagram showing the configuration of an electronic musical apparatus according to an embodiment of the present subject matter. According to the electronic musical apparatus 1 of FIG. 1, a user can perform music and produce music such as a musical piece.

The electronic musical apparatus 1 includes a performance operating element 2, an input I/F (interface) 3, a setting operating element 4, a detection circuit 5, a display 6 and a display circuit 7. The performance operating element 2 includes a keyboard including a plurality of keys, for example. Further, the performance operating element 2 may include a pedal operator that is operated by the user with a foot (an expression pedal, a pedal switch or a damper pedal, for example), and a rotary operator (a rotary encoder, for example) or a slide operator (a linear encoder, for example). The performance operating element 2 is connected to a bus 19 via the input I/F 3, and performance data based on a performance operation of the user is input by the performance operating element 2.

The setting operating element 4 includes a switch that is operated in an on-off manner, a variable resistor that is operated in a rotational manner or a sliding manner, etc., and is connected the bus 19 through the detection circuit 5. The setting operating element 4 is used for switching of a tone color, adjustment of the volume, on-off of a power supply and various settings. The display 6 is connected to the bus 19 through the display circuit 7. Various information relating to a musical performance, settings and so on is displayed in the display 6. At least part of the display 6 and the setting operating element 4 may be constituted by a touch panel display.

The electronic musical apparatus 1 further includes a RAM (Random Access Memory) 9, a ROM (Read Only Memory) 10, a CPU (Central Processing Unit) 11, a timer 12, a storage device 13 and a communication I/F (interface) 14. The RAM 9, the ROM 10, the CPU 11, the storage device 13 and the communication I/F 14 are connected to the bus 19, and the timer 12 is connected to the CPU 11. External equipment such as an external storage device 15 may be connected to the bus 19 via a communication I/F 14. The RAM 9, the ROM 10 and the CPU 11 constitute a computer. Further, the RAM 9, the ROM 10, the CPU 11 and the storage device 13 constitute the audio parameter adjustment apparatus 100.

The RAM 9 is made of a volatile memory, for example, is used as a working area for the CPU 11 and temporarily stores various data. The ROM 10 is made of a non-volatile memory, for example, and stores a computer program such as a control program and the audio parameter adjustment program. The CPU 11 executes the audio parameter adjustment program stored in the ROM 10 on the RAM 9 to perform an audio parameter setting process and an audio parameter control process, mentioned below. The timer 12 provides clock information such as a current time to the CPU 11.

The storage device 13 includes a storage medium such as a hard disc, an optical disc, a magnetic disc or a memory card. Similarly to the storage device 13, the external storage device 15 includes a storage medium such as a hard disc, an optical disc, a magnetic disc or a memory card. The above-mentioned audio parameter adjustment program may be stored in the storage device 13 or the external storage device 15.

The audio parameter adjustment program may be supplied in the form of being stored in a recording medium which is readable by a computer, and installed in the ROM 10 or the storage device 13. Further, in a case where the communication I/F 14 is connected to a communication network, the audio parameter adjustment program delivered from a server connected to the communication network may be installed in the ROM 10 or the storage device 13.

The electronic musical apparatus 1 further includes a tone generator 16 and a sound system 18. The tone generator 16 is connected to the bus 19, and the sound system 18 is connected to the tone generator 16 and the bus 19. The tone generator 16 generates an audio signal based on performance data input from the performance operating element 2 or sequence data provided from the storage device 13 and gives acoustic effects to the audio signal. The acoustic effects include such as Reverb, Delay, Modulation, Distortion, Brilliance and Enhancement, for example. The sound system 18 includes a digital/analog (D/A) conversion circuit, an amplifier and a speaker. The sound system 18 generates a musical sound based on an audio signal provided by the tone generator 16.

[2] Functional Configuration of Audio Parameter Adjustment Apparatus

Figure 2:
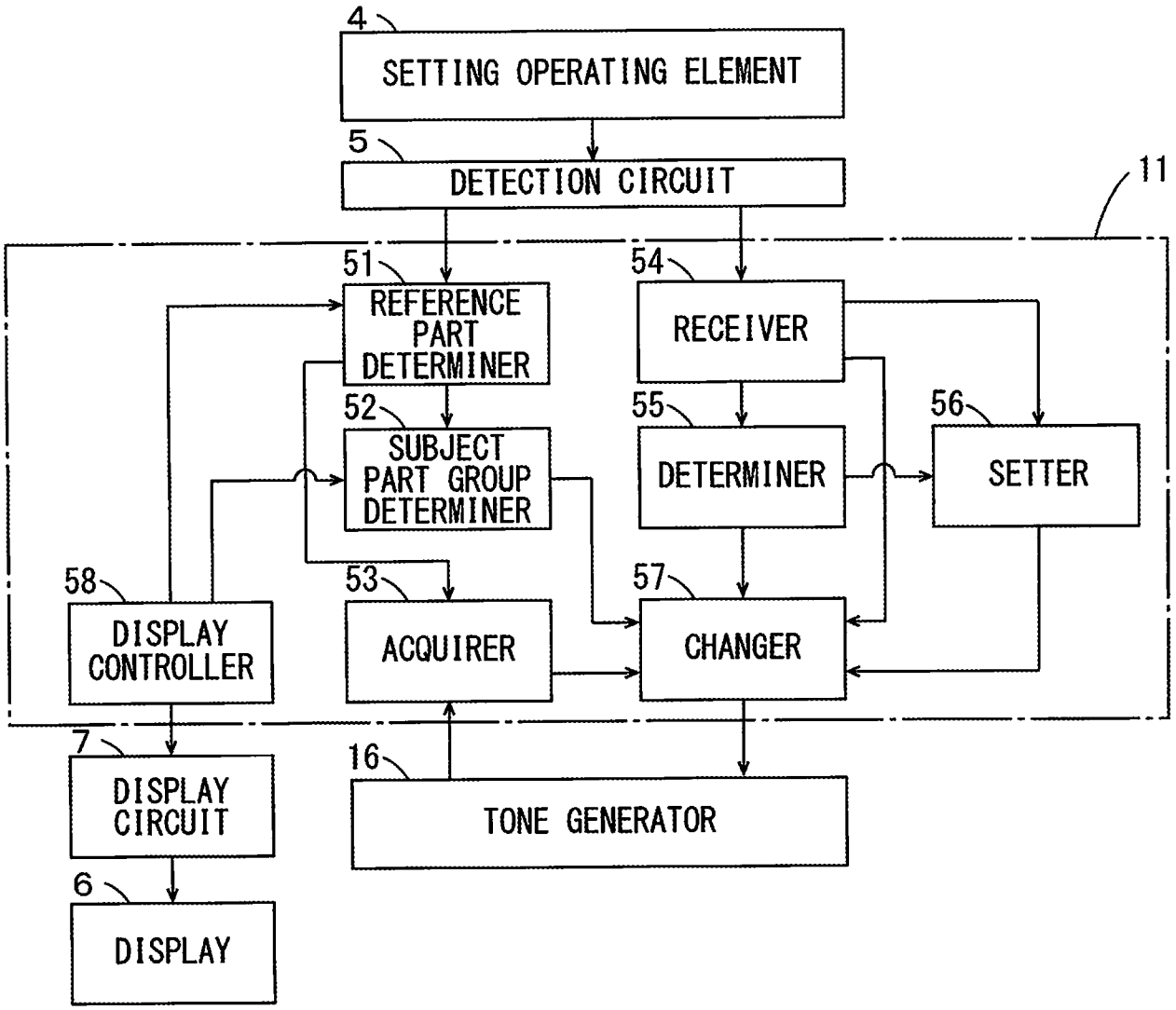
FIG. 2 is a block diagram showing the functional configuration of an audio parameter adjustment apparatus.

FIG. 2 is a block diagram showing the functional configuration of the audio parameter adjustment apparatus 100. As shown in FIG. 2, the audio parameter adjustment apparatus 100 includes a reference part determiner 51, a subject part group determiner 52, an acquirer 53, a receiver 54, a judge 55, a setter 56, a changer 57 and a display controller 58. The CPU 11 of FIG. 1 executes the audio parameter adjustment program stored in the ROM 10 or the storage device 13 to implement functions of each component of the audio parameter adjustment apparatus 100 in FIG. 2.

A plurality (three or more) of parts are set in the present embodiment. The plurality of parts includes a rhythm part and normal parts. For example, the tone color of a percussion instrument such as drums is assigned to the rhythm part, for example. The tone color of a musical instrument (a piano, a guitar and a bass or the like, for example) that can generate a plurality of pitches that form a melody or an accompaniment is assigned to the normal parts. The sound input from the outside through a microphone or the like (an input sound) may be assigned to an either part. Further, each part is classified into any of a manual performance part and an automatic performance part. In the manual performance part, the user operates the performance operating element 2 of FIG. 1 to perform music in real time. In the automatic performance part, automatic performance is carried out based on the sequence data prepared in advance. The sequence data is MIDI (Musical Instrument Digital Interface) data, for example. The tone color or the input sound assigned to each part, and the sequence data of the automatic performance part are stored in the storage device 13 of FIG. 1.

The reference part determiner 51 determines one of the plurality of parts as a reference part. The part, which the user has selected by operating the setting operating element 4, is determined as the reference part, for example. As described below, a determination condition for determining the reference part may be defined, and the reference part may be determined based on the determination condition. The subject part group determiner 52 determines the other plurality of parts except for the reference part out of the plurality of parts as a subject part group. Hereinafter, each of the plurality of parts included in the subject part group determined by the subject part group determiner 52 is referred to as a subject candidate part.

The acquirer 53 acquires a change pattern of a first audio parameter value set for the reference part. In the present example, the first audio parameter is the volume, and the change pattern is the envelope representing the temporal change of volume. The envelope representing the temporal change of volume is acquired from the audio signal of the reference part output from the tone generator 16, for example.

The receiver 54 receives selection of a second audio parameter to be set for the subject part group. For example, the user selects the second audio parameter by operating the setting operating element 4 of FIG. 1. As the second audio parameter, Volume, Cutoff, Resonance, Pitch, Pan, LFO (Low Frequency Oscillator) and the like can be selected.

The judge 55 judges whether a second audio parameter value is to be changed in regard to each subject candidate part of the subject part group determined by the subject part group determiner 52 (hereinafter referred to as changeability judgement). Hereinafter, the subject candidate part having the second audio parameter value that has been judged to be changed in the changeability judgement is referred to as a change subject part. The setter 56 sets a change coefficient indicating the degree to which the second audio parameter value is changed in regard to each change subject part. In the present example, a changeability condition for making the changeability judgement and a coefficient setting condition for setting a change coefficient are defined. The changeability condition and the coefficient setting condition may be fixed or may be changeable by the user. The judge 55 carries out the changeability judgement based on the changeability condition, and the setter 56 sets a change coefficient based on the coefficient setting condition. Details of the changeability condition and the coefficient setting condition will be described below.

The changer 57 changes the second audio parameter value of the subject part group according to the change pattern acquired by the acquirer 53. In the present example, the second audio parameter value of the change subject part of the subject part group is changed. In this case, the changer 57 controls the second audio parameter value of the change subject part by controlling the tone generator 16 of FIG. 1. The display controller 58 causes the display 6 to display a collective setting screen for determining a reference part and a subject part group. Details of the collective setting screen will be described below.

[3] First and Second Audio Parameters

Figure 3:
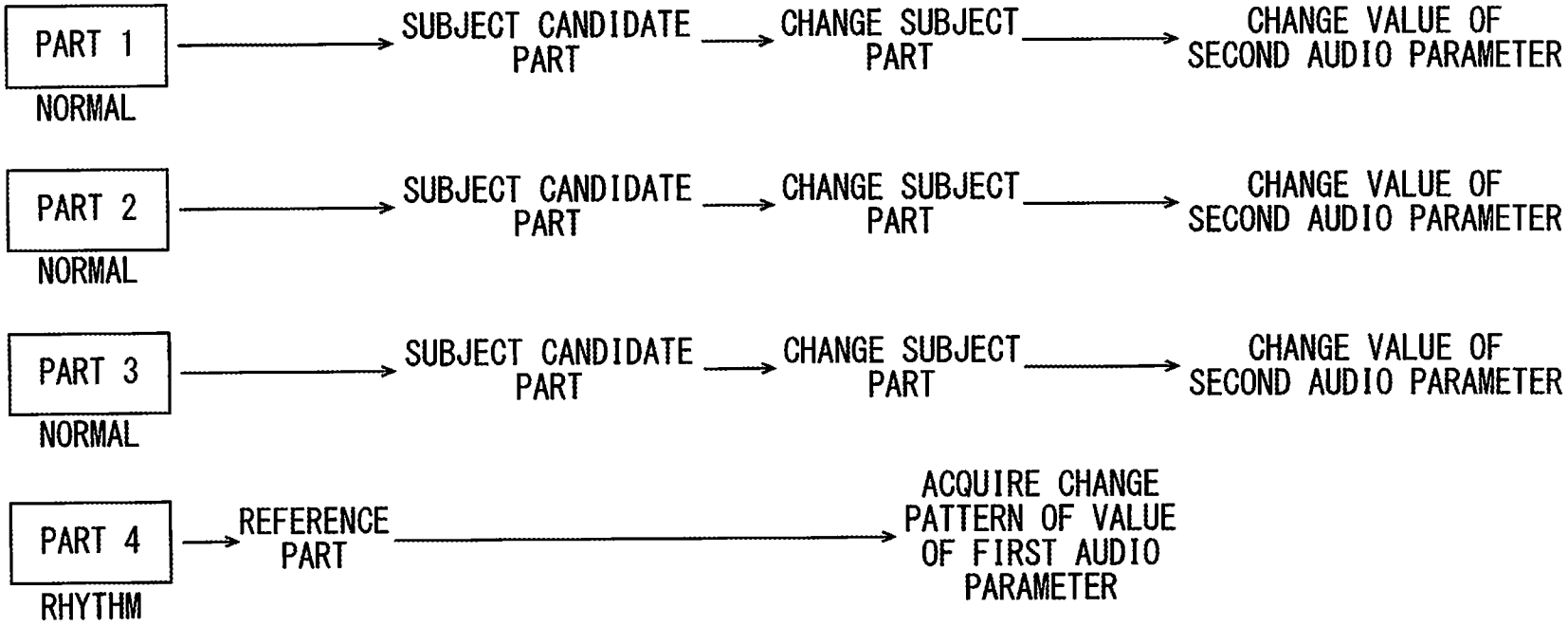
FIG. 3 is a diagram for explaining the relationship between a reference part and a subject part group.

FIG. 3 is a diagram for explaining the relationship between the reference part and the subject part group. In FIG. 3, each part is denoted with a part number "N" (N is a positive integer) in order to distinguish among a plurality of parts. In the present example, parts "1" to "4" are set. Parts "1" to "3" are normal parts, and a part "4" is a rhythm part. The reference part determiner 51 of FIG. 2 determines the part "4," which is the rhythm part, as the reference part, for example. When the reference part is determined, the subject part group determiner 52 of FIG. 2 determines the other three parts "1" to "3" except for the reference part as the subject part group. Subsequently, the judge 55 of FIG. 2 determines change subject parts from the subject part group. In the present example, all of the parts "1" to "3" included in the subject part group are determined as change subject parts.

When musical performance is started, the acquirer 53 of FIG. 2 acquires a change pattern of the first audio parameter value of the part "4," which is the reference part. The changer 57 of FIG. 2 changes the second audio parameter values of the parts "1" to "3" according to the acquired change pattern. Thus, the second audio parameter values of the parts "1" to "3" are changed in association with the change of the first audio parameter value of the part "4."

Figure 4:
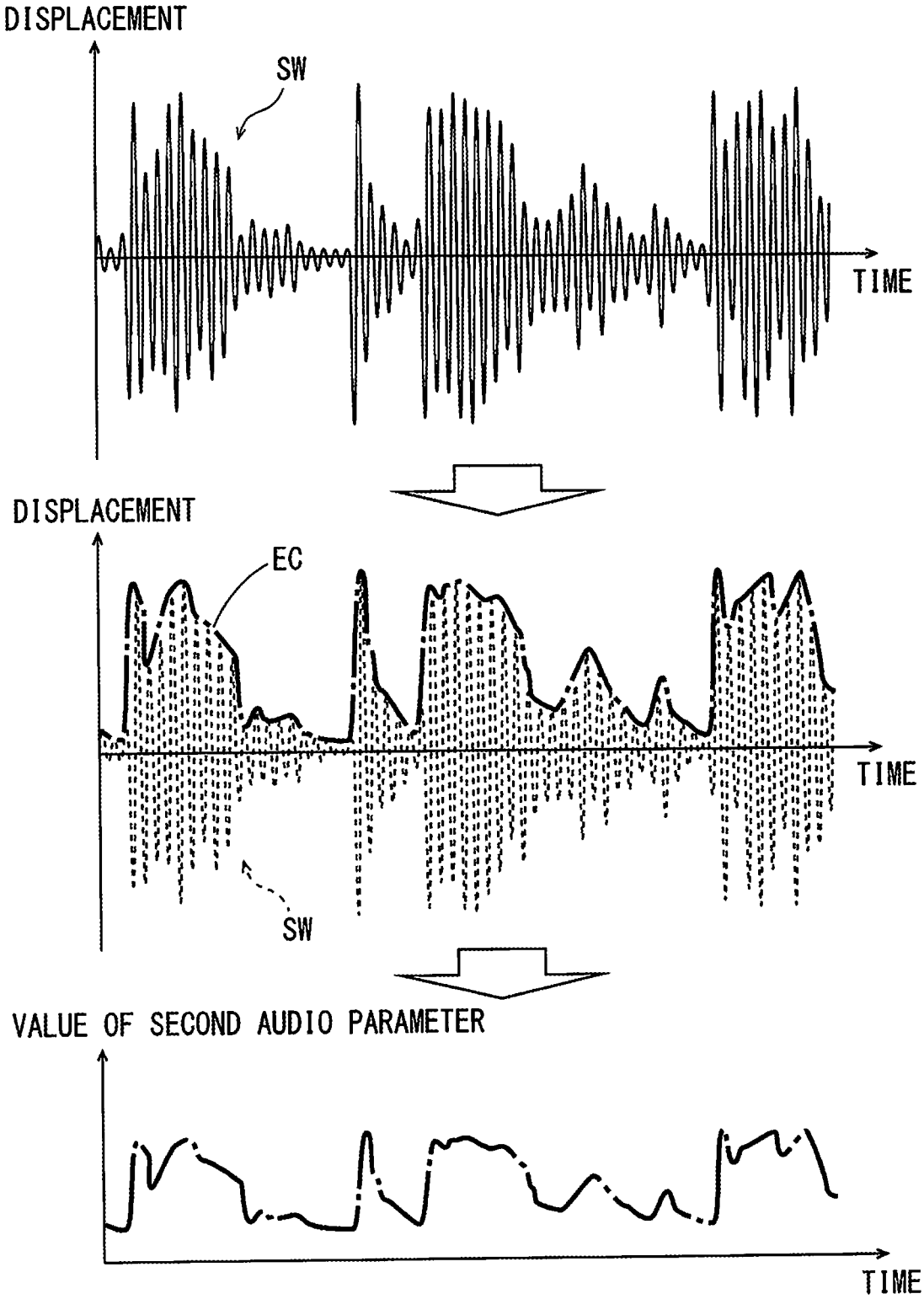
FIG. 4 is a diagram for explaining the relationship between the volume of the reference part and a second audio parameter of the subject part group.

For example, the envelope representing the temporal change of the volume of the reference part is extracted as a change pattern, and the second audio parameter values (the volume, for example) of the subject part group are changed according to the envelope. FIG. 4 is a diagram for explaining the relationship between the volume of the reference part and the second audio parameter of the subject part group. The waveform SW of an audio signal (an audio waveform) of the reference part is shown in the upper field of FIG. 4, an envelope EC of the peak value of the audio waveform SW is shown in the center field, and the second audio parameter is shown in the lower field. In FIG. 4, the abscissa indicates time, and the ordinate indicates displacement and the second audio parameter value. The amplitude of the audio waveform SW shown in the upper field in FIG. 4 indicates the volume of the reference part. Further, the envelope EC shown in the center field in FIG. 4 indicates the temporal change of the volume of the reference part. The second audio parameter values of the subject part group are changed in association with this envelope EC. The degree to which a second audio parameter value is changed depends on the change coefficient set for each change subject part.

Here, the second audio parameter value cannot be changed effectively depending on the manner in which the first audio parameter value of the reference part is changed. For example, in a case where the frequency of change of the first audio parameter value is low, the frequency of change of the second audio parameter value is also low. Thus, musical appeal is likely to be poor.

As such, being a rhythm part may be defined as a determination condition of a reference part, for example. Generally, in the rhythm part, a plurality of sounds are successively arranged on a time axis, and each sound has relatively large attack and attenuation. Therefore, the volume of the rhythm part changes continuously or intermittently. Therefore, in a case where a rhythm part is determined as a reference part, the second audio parameter values of the subject part group are effectively changed according to the temporal change of volume of the reference part. Alternatively, the setting of an arpeggio may be defined as a determination condition. In a case where an arpeggio is set, the pitch of the corresponding part is successively changed according to a preset arpeggio pattern. Because a plurality of sounds are also successively arranged on the time axis in this case, the volume is likely to be changed continuously or intermittently. Therefore, in a case where the part with the setting of an arpeggio is determined as a reference part, the second audio parameter values of the subject part group are effectively changed according to the temporal change of volume of the reference part.

Further, it may be defined as a determination condition that the degree to which the first audio parameter value is changed meets a certain standard. For example, it may be defined as a determination condition that the volume shifts between an upper range and a lower range the certain number of times or more in every certain period of time with a threshold value used as a boundary. Because the volume of the reference part is also changed continuously or intermittently in this case, the second audio parameter values of the subject part group are effectively changed according to the temporal change of volume of the reference part.

Figure 5:
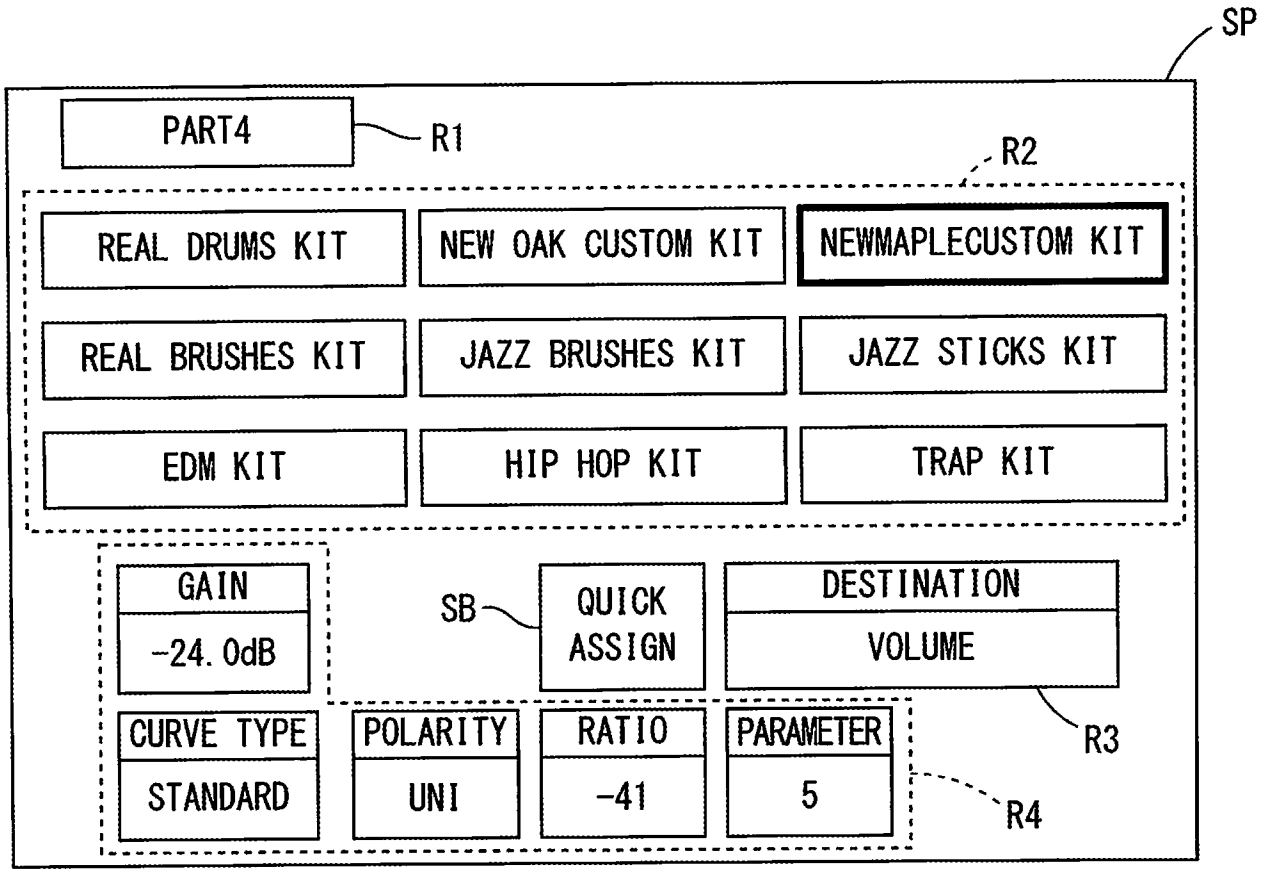
FIG. 5 is a diagram showing an example of a collective setting screen.

In the present example, a collective setting screen for collectively setting the reference part and the subject candidate parts is displayed in the display 6 of FIG. 1 when the reference part and the subject part group are determined. FIG. 5 is a diagram showing an example of the collective setting screen. The collective setting screen SP of FIG. 5 includes a part display region R1, a kit selection region R2, a parameter selection region R3, an item display region R4 and a collective setting button SB.

The part (part number) currently being selected as the reference part is displayed in the part display region R1. In the example of FIG. 5, the currently selected part "4" is a rhythm part. In the kit selection region R2, a plurality (nine in the present example) of rhythm kits that can be selected as tone colors of the rhythm part are displayed. Each rhythm kit is a combination of a plurality of rhythm musical instruments. A different rhythm pattern may be set for each rhythm kit. The user selects a desired rhythm kit from the plurality of displayed rhythm kits.

In the parameter selection region R3, the second audio parameter can be selected. "Destination" represents the second audio parameter. In the example of FIG. 5, the volume is selected as the second audio parameter (Destination). In the item display region R4, a plurality of setting items such as "Gain" and "Polarity" relating to the second audio parameter are displayed. The user can adjust the manner in which the second audio parameter values of the subject part group are changed by changing a numerical value or a condition of each setting item. In this case, the manner in which the second audio parameter values of a plurality of parts are changed may be collectively adjustable, and the manner in which the second audio parameter values are changed may be individually adjustable for each part.

When the collective setting button SB is operated, the currently selected part (the part displayed in the part display region R1) is determined as the reference part, and the plurality of other parts are determined as the subject part group. Further, when the collective setting button SB is operated, the selection of the second audio parameter displayed in the parameter selection region R3 is received.

[4] Condition Table

Specific examples of the changeability condition and the coefficient setting condition will be described. In the present example, a condition table that defines the changeability condition and coefficient setting condition is used. FIG. 6 is a diagram showing one example of the condition table. In the condition table of FIG. 6, the relationship between a plurality of audio parameters (hereinafter referred to as selection subject parameters) that may be selected as the second audio parameters and a sound source system set for a subject candidate part is defined. As the sound source system, a PCM (Pulse Code Modulation) sound source or an FM (Frequency Modulation) sound source is used. A parameter name and a change coefficient corresponding to each selection subject parameter are defined for each sound source system.

As for the PCM sound source, parameter names and change coefficients are separately defined for normal parts and a rhythm part. In a case where the PCM sound source is used, even when the value of "Cutoff," "Resonance" or the like is changed for the rhythm part, the change is hardly perceptible aurally. As such, it is defined as the changeability condition that part of the selection subject parameter values is not to be changed for the rhythm part. In the condition table of FIG. 6, the parameter names and the change coefficients corresponding to the selection subject parameters that are not to be changed are indicated by "x."

The judge 55 of FIG. 2 carries out the changeability judgement of each subject candidate part based on the condition table of FIG. 6. For example, in a case where "Cutoff" is set as a second audio parameter, a subject candidate part is a normal part, and the sound source system of the subject candidate part is the PCM sound source, the judge 55 judges that the second audio parameter value of the subject candidate part is to be changed. On the other hand, in a case where "Cutoff" is set as a second audio parameter, a subject candidate part is a rhythm part, and the sound source system of the subject candidate part is the PCM sound source, the judge 55 judges that the second audio parameter value of the subject candidate part is not to be changed. Thus, a change subject part is determined from the subject part group.

The setter 56 of FIG. 2 sets the change coefficient of each change subject part based on the condition table of FIG. 6. For example, in a case where "Resonance" is set as the second audio parameter, and the sound source system of a change subject part is the FM sound source, the change coefficient of the change subject part is set to "66."

[5] Parameter Control Information

The storage device 13 of FIG. 1 has a plurality of setting storage regions for each part. A plurality of parameter control information pieces are respectively stored in the plurality of setting storage regions. FIG. 7 is a diagram showing the example of the plurality of parameter control information pieces stored in the plurality of setting storage regions. In the example of FIG. 7, sixteen setting storage regions are provided for one part. The setting storage regions are respectively denoted with set numbers "1" to "16." In this case, a maximum of sixteen parameter control information pieces can be set for one part.

The parameter control information pieces include a reference parameter, a control parameter and a change coefficient. In this case, the control parameter is controlled based on the reference parameter. The parameter assigned to any operator included in the performance operating element 2 of FIG. 1 is set as the reference parameter, for example. Any audio parameter is set as the control parameter. The change coefficient indicates the degree to which the control parameter value is changed with respect to the change of the reference parameter value.

In the example of FIG. 7, the parameter control information pieces are stored in the setting storage regions of the set numbers "1" and "2." Specifically, in the setting storage region of the set number "1," "Knob 1" is stored as the reference parameter, "Volume" is stored as the control parameter and "32" is stored as the change coefficient. The knob 1 is one of the rotary operators included in the performance operating element 2 of FIG. 1. In this case, "Volume" is controlled based on an operation of the knob 1. In the setting storage region of the set number "2," "foot controller 1" is stored as the reference parameter, "Cut Off" is stored as the control parameter and "61" is stored as the change coefficient. The foot controller 1 is one of the pedal operators included in the performance operating element 2 of FIG. 1. In this case, "Cutoff" is controlled based on an operation of the foot controller 1.

In the present embodiment, in a case where the reference part and the change subject parts are determined, the first audio parameter is stored as the reference parameter, and the second audio parameter is stored as the control parameter, in any of the setting storage regions of the change subject parts. Thus, the second audio parameter is controlled based on the first audio parameter.

[6] Audio Parameter Adjustment Method

Figure 8:
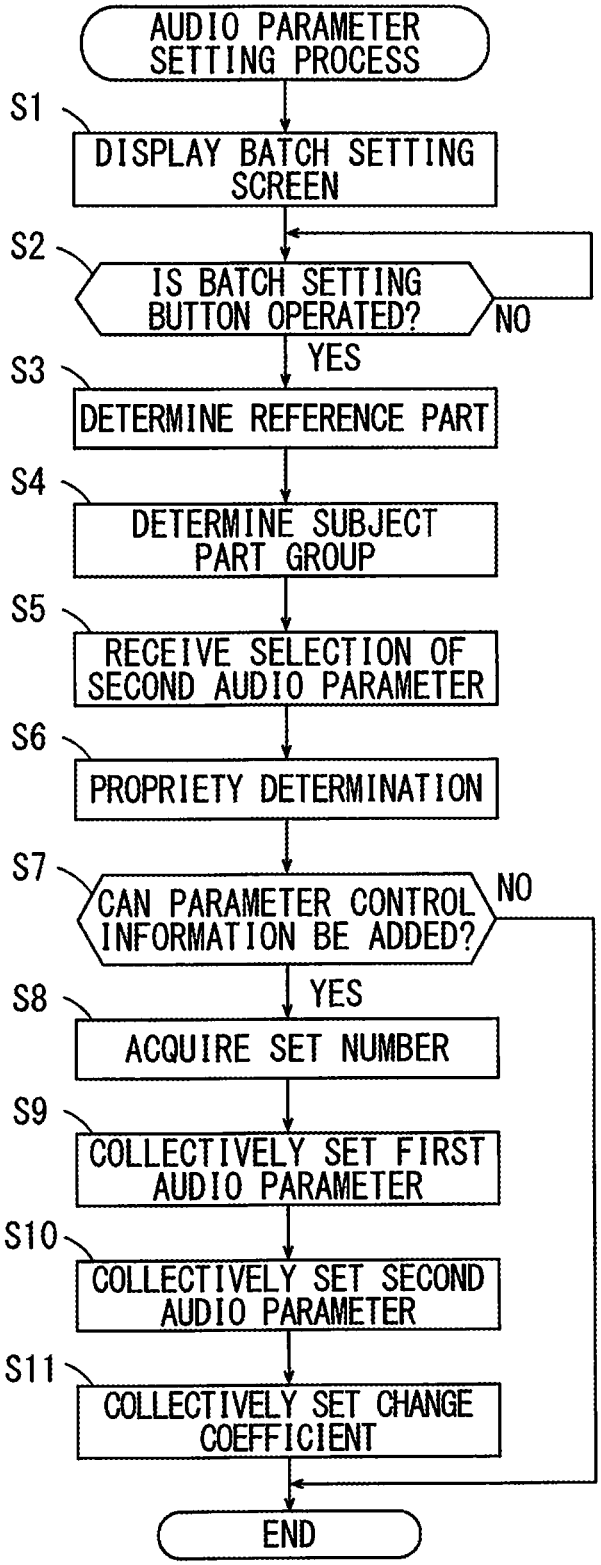
FIG. 8 is a flow chart showing one example of an audio parameter setting process performed by each function element of FIG. 2.
Figure 9:
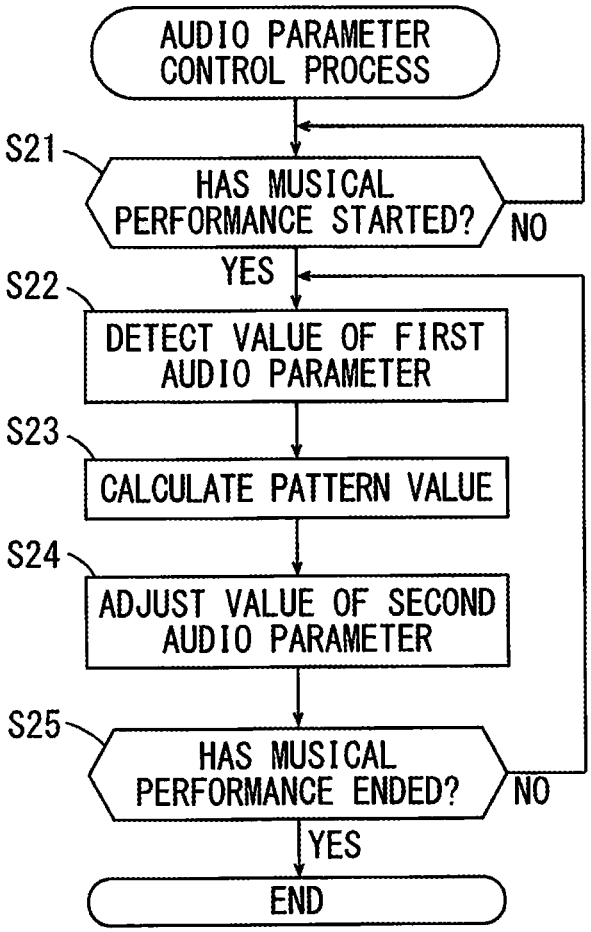
FIG. 9 is a flow chart showing one example of an audio parameter control process performed by each function element of FIG. 2.

An audio parameter setting process and an audio parameter control process using the audio parameter adjustment method according to the present embodiment will be described. FIG. 8 is a flow chart showing one example of the audio parameter setting process performed by each function element of FIG. 2. FIG. 9 is a flow chart showing one example of the audio parameter control process performed by each function element of FIG. 2. The audio parameter adjustment process of FIG. 8 and the audio parameter control process of FIG. 9 are performed when the CPU 11 of FIG. 1 executes the audio parameter adjustment program stored in the ROM 10 or the storage device 13. The audio parameter adjustment process of FIG. 8 is performed before the musical performance in the electronic musical apparatus 1, and the audio parameter control process of FIG. 9 is performed during the musical performance in the electronic musical apparatus 1.

In the audio parameter setting process of FIG. 8, the display controller 58 first causes the display 6 of FIG. 1 to display the collective setting screen SP (see FIG. 5) (step S1). The part that is being selected as a reference part at that point in time is displayed in the part display region R1 of the collective setting screen SP. Next, the reference part determiner 51 judges whether the collective setting button SB has been operated in the collective setting screen SP (step S2). The reference part determiner 51 repeats the step S2 until the collective setting button SB is operated.

When the collective setting button SB is operated, the reference part determiner 51 determines the part that is being selected at that point in time as the reference part (step S3). Further, the subject part group determiner 52 determines all other parts except for the reference part as the subject part group (step S4). Further, the receiver 54 receives selection of the second audio parameter (step S5).

Next, based on the changeability condition defined by the condition table, the judge 55 carries out the changeability judgement about whether the second audio parameter value received in the step S5 is to be changed in regard to each subject candidate part included in the determined subject part group (step S6). Thus, the change subject part is determined.

Next, the setter 56 judges whether the parameter control information can be added in regard to each determined change subject part (step S7). Specifically, whether a setting storage region in which the parameter control information is not stored is present among the plurality of setting storage regions corresponding to the change subject parts is judged. In a case where the parameter control information is not stored in any of the setting storage regions, the setter 56 judges that the parameter control information can be added. In a case where the parameter control information is stored in all of the setting storage regions, the setter 56 judges that the parameter control information cannot be added.

In a case where the parameter control information cannot be added in regard to any of the change subject parts, the audio parameter setting process ends. In a case where the parameter control information can be added in regard to all of the change subject parts, the setter 56 acquires the set number of the setting storage region in which the parameter control information is to be stored in regard to each change subject part (step S8). For example, in a case where the parameter control information is stored in the setting storage regions of the set numbers "1" and "2" as shown in the example of FIG. 7, the next set number "3" is acquired.

Next, the reference part determiner 51 collectively sets the first audio parameters in regard to all of the change subject parts (step S9). Specifically, the first audio parameter is stored as the reference parameter in the setting storage region having the set number acquired in the step S8 in regard to all of the change subject parts.

Next, the subject part group determiner 52 collectively sets the second audio parameters in regard to all of the change subject parts (step S10). Specifically, the second audio parameter received in the step S5 is stored as a control parameter in the setting storage region having the set number acquired in the step S8 in regard to all of the change subject parts.

Next, the setter 56 collectively sets the change coefficient in regard to all of the change subject parts based on the coefficient setting condition defined by the condition table (step S11). Specifically, the change coefficients corresponding to the second audio parameter set in the step S10 are acquired from the condition table in regard to all of the change subject parts. The acquired change coefficients are stored in the setting storage region having the set number acquired in the step S8. Thus, the audio parameter setting process ends.

The reference part may be suitably changeable. When the reference part is changed, the process of the steps S3 to S11 is repeated. Further, the part that is selectable as the reference part may be restricted. For example, only the rhythm part may be selectable as the reference part. Further, the part selected in the collective setting screen SP is not determined as the reference part, but the reference part may be determined based on the determination condition. Further, the second audio parameter may be suitably changeable. When the second audio parameter is changed, the process of the steps S5 to S11 is repeated.

In a case where the parameter control information cannot be added in regard to any of the change subject parts in the step S7, the audio parameter setting process does not end, but the parameter control information (the reference parameter, the control parameter and the change coefficient) may be set for the change subject part to which the parameter control information can be added.

In the audio parameter control process of FIG. 9, the acquirer 53 first judges whether the start of musical performance has been detected (step S21). For example, in a case where the setting operating element 4 of FIG. 1 includes a start button, and the start button is operated by the user, the start of musical performance is detected. As for an automatic performance part, when the start of musical performance is detected, an automatic performance part is reproduced according to the sequence data stored in the storage device 13 of FIG. 1. Thus, a performance sound of the automatic performance part is output from the sound system 18 of FIG. 1. Further, as for a manual performance part, a performance sound of the manual performance part is output from the sound system 18 based on an operation of the performance operating element 2 (the keyboard, for example) by the user.

The acquirer 53 repeats the step S21 until the start of musical performance is detected. When the start of musical performance is detected, the acquirer 53 acquires the first audio parameter value set for the reference part (step S22). For example, the volume of the reference part is acquired from an audio signal output from the tone generator 16 of FIG. 1. The acquirer 53 acquires a change pattern of the first audio parameter value (step S23). Next, the changer 57 adjusts the second audio parameter value of each change subject part according to the acquired change pattern (step S24). In this case, the second audio parameter value is calculated based on the change coefficient set for each change subject part.

Next, the changer 57 judges whether the stop of musical performance is detected (step S25). For example, the setting operating element 4 of FIG. 1 includes a stop button. When the stop button is operated, the stop of musical performance is detected. Further, the stop of musical performance may be detected when a reproduction position in the sequence data reaches an end position. When the stop of musical performance is detected, reproduction of an automatic performance part is stopped. When the stop of the performance is not detected, the acquirer 53 returns to the step S22. When the stop of musical performance is detected, the audio parameter adjustment process ends.

[7] Effects of Embodiment

In the audio parameter adjustment apparatus 100 according to the present embodiment, in a case where one of a plurality of parts is determined as a reference part, the plurality of other parts except for the reference part are determined as a subject part group. In this case, as for the plurality of other parts except for the reference part, it is not necessary to set the relationship with the reference part for each part, and the plurality of these parts can be collectively set as the subject part group. Further, second audio parameter values of the subject part group can be changed according to the change pattern of the first audio parameter value of the reference part. Thus, the audio parameter values of the plurality of parts can be changed easily and effectively.

Further, in the present embodiment, whether the second audio parameter value is to be changed in regard to each subject candidate part included in the subject part group is judged based on the selected second audio parameter and the changeability condition, and the second audio parameter of the subject part group is controlled based on the result of judgement. Thus, the second audio parameter values of the subject part group can be appropriately controlled according to a type of each subject candidate part, a tone generation format and the like.

Further, in the present embodiment, a change coefficient is set based on the second audio parameter and the coefficient setting condition for the subject candidate part (change subject part) having the second audio parameter value that has been judged to be changed. Thus, the second audio parameter value of each change subject part can be changed more effectively.

In the above-mentioned embodiment, the change subject part is determined from the subject part group based on the changeability condition, and the second audio parameter value of each change subject part is changed according to the change pattern of the first audio parameter value. However, the present subject matter is not limited to this. For example, the second audio parameter values of all of the subject candidate parts included in the subject part group may be changed according to the change pattern of the first audio parameter value. In that case, the judge 55 of FIG. 2 does not have to be provided. While all parts except for the reference part are determined as a subject part group in the above-mentioned embodiment, the plurality of parts satisfying a certain condition or the plurality of parts selected by the user out of all parts except for the reference part may be determined as the subject part group.

The first audio parameter is not limited to the volume of a reference part. For example, the pitch of the reference part may be used as the first audio parameter. Further, the parameter assigned to the pedal operator, the rotary operator or the slide operator of the performance operating element 2 may be used as the first audio parameter.

While the audio parameter selected by the user is selected as the second audio parameter in the above-mentioned embodiment, a predetermined audio parameter may be determined as the second audio parameter. In that case, the receiver 54 of FIG. 2 does not have to be provided. While a change coefficient is set for each change subject part in the above-mentioned embodiment, a common change coefficient may be set for all of the change subject parts. In that case, the setter 56 of FIG. 2 does not have to be provided. While various settings are made in the collective setting screen SP in the above-mentioned embodiment, these settings may be made by another method with the collective setting screen SP not displayed. In that case, the display controller 58 of FIG. 2 does not have to be provided.

While each function element of FIG. 2 is implemented by hardware such as the CPU 11 and software such as an audio parameter adjustment program in the above-mentioned embodiment, these function elements may be implemented by hardware such as an electronic circuit.

The audio parameter adjustment apparatus 100 may be applied to another electronic apparatus such as a personal computer, a smartphone or a tablet terminal.

While preferred embodiments of the present subject matter have been described above, it is to be understood that variations and modifications will be apparent to those skilled in the art without departing the scope and spirit of the present subject matter. The scope of the present subject matter, therefore, is to be determined solely by the following claims.

We claim:

1. An audio parameter adjustment apparatus, comprising:

a reference part determiner to determine a reference part from a plurality of parts including at least three parts;

a subject part group determiner to determine a subject part group from the plurality of parts, the subject part group not including the reference part;

an acquirer to acquire a change pattern of a value of a first audio parameter set for the reference part; and a changer to change a value of a second audio parameter set for the subject part group according to the acquired change pattern;

a receiver to receive a selection of the second audio parameter; and a judge to judge whether the value of the selected second audio parameter is to be changed in regard to each part of the subject part group based on the selected second audio parameter and a changeability condition, wherein the changer is further configured to change the value of the second audio parameter according to the change pattern in regard to a part of the subject part group having the value of the second audio parameter that has been judged to be changed.

2. The audio parameter adjustment apparatus according to claim 1, wherein the first audio parameter is a volume, and the change pattern is an envelope representing a temporal change in volume.

3. The audio parameter adjustment apparatus according to claim 1, further comprising:

a setter to set a change coefficient indicating a degree to which the second audio parameter is to be changed for a part having the value of the second audio parameter that has been judged to be changed based on the selected second audio parameter and a coefficient setting condition.

4. The audio parameter adjustment apparatus according to claim 1, wherein the reference part determiner is further configured to determine the reference part satisfying a determination condition from the plurality of parts.

5. The audio parameter adjustment apparatus according to claim 4, wherein the determination condition occurs when the value of the first audio parameter shifts between an upper range and a lower range at least a minimum number of times within a period of time, and a threshold value forms a boundary between the upper range and the lower range.

6. The audio parameter adjustment apparatus according to claim 4, wherein the determination condition occurs when an arpeggio is set.

7. An audio parameter adjustment method comprising:

determining a reference part from a plurality of at least three parts;

determining a subject part group from the plurality of parts, the subject part group not including the reference part;

acquiring a change pattern of a value of a first audio parameter set for the reference part; and changing a value of a second audio parameter set for the subject part group according to the acquired change pattern;

receiving selection of the second audio parameter; and judging whether the value of the selected second audio parameter is to be changed in regard to each part of the subject part group based on the selected second audio parameter and a changeability condition, wherein the changing the value of the second audio parameter includes changing the value of the second audio parameter according to the change pattern in regard to a part of the subject part group having the value of the second audio parameter that has been judged to be changed.

8. The audio parameter adjustment method according to claim 7, wherein the first audio parameter is a volume, and the change pattern is an envelope representing a temporal change in volume.

9. The audio parameter adjustment method according to claim 7, further comprising:

setting a change coefficient indicating a degree to which the second audio parameter is to be changed for a part having the value of the second audio parameter that has been judged to be changed based on the selected second audio parameter and a coefficient setting condition.

10. The audio parameter adjustment method according to claim claims 7, wherein the determining a reference part further includes determining the reference part satisfying a determination condition from the plurality of parts.

11. The audio parameter adjustment method according to claim 10, wherein the determination condition occurs when the value of the first audio parameter shifts between an upper range and a lower range at least a minimum number of times within a period of time, and a threshold value forms a boundary between the upper range and the lower range.

12. The audio parameter adjustment method according to claim 10, wherein the determination condition occurs when an arpeggio is set.

13. A non-transitory computer readable medium comprising an audio parameter adjustment program configured, when executed by a computer, to cause the computer to:

determine a reference part from a plurality of parts including at least three parts;

determine a subject part group from the plurality of parts, the subject part group not including the reference part;

acquire a change pattern of a value of a first audio parameter set for the reference part;

change a value of a second audio parameter set for the subject part group according to the acquired change pattern;

receive a selection of the second audio parameter; and judge whether the value of the selected second audio parameter is to be changed in regard to each part of the subject part group based on the selected second audio parameter and a changeability condition, wherein the changing the value of a second audio parameter includes changing the value of the second audio parameter according to the change pattern in regard to a part of the subject part group having the value of the second audio parameter that has been judged to be changed.

14. The non-transitory computer readable medium storing the audio parameter adjustment program according to claim 13, wherein the first audio parameter is a volume, and the change pattern is an envelope representing a temporal change in volume.

15. The non-transitory computer readable medium storing the audio parameter adjustment program according to claim 13, further configured, when executed by the computer, to cause the computer to:

set a change coefficient indicating a degree to which the second audio parameter is to be changed for a part having the value of the second audio parameter that has been judged to be changed based on the selected second audio parameter and a coefficient setting condition.

16. The non-transitory computer readable medium storing the audio parameter adjustment program according to claim 13, wherein the determining a reference part further includes determining the reference part satisfying a determination condition from the plurality of parts.

17. The non-transitory computer readable medium storing the audio parameter adjustment program according to claim 16, wherein the determination condition occurs when the value of the first audio parameter shifts between an upper range and a lower range at least a minimum number of times within a certain period of time, and a threshold value forms a boundary between the upper range and the lower range.

18. The non-transitory computer readable medium storing the audio parameter adjustment program according to claim 16, wherein the determination condition occurs when an arpeggio is set.

* * * * *